US006240988B1

(12) United States Patent
Wolf

(10) Patent No.: US 6,240,988 B1
(45) Date of Patent: Jun. 5, 2001

(54) PROCESS AND DEVICE FOR PRODUCTION OF OCTAGONAL OR POLYGONAL BEAMS

(75) Inventor: Johann Wolf, Scharnstein (AT)

(73) Assignee: Wol Systembau Gesellschaft m.b.H., Scharnstein (AT)

( * ) Notice: Subject to any disclaimer, the term of this patent is extended or adjusted under 35 U.S.C. 154(b) by 0 days.

(21) Appl. No.: 09/356,412

(22) Filed: Jul. 16, 1999

(30) Foreign Application Priority Data

Jul. 17, 1998 (AT) ..... 1242/98

(51) Int. Cl.[7] ..... B27L 7/00; B27L 11/00; B27M 1/08

(52) U.S. Cl. ..... 144/369; 144/3.1; 144/39; 144/242.1; 144/246.1; 144/250.24; 144/367; 144/357

(58) Field of Search ..... 144/3.1, 39, 246.1, 144/242.1, 250.23, 250.24, 357, 369, 378, 373; 198/412

(56) References Cited

U.S. PATENT DOCUMENTS 4,327,789 * 5/1982 Reuter ..... 144/39

FOREIGN PATENT DOCUMENTS

| | | |
|---|---|---|
| 400 825 | 3/1996 | (AT) . |
| 2 137 091 | 6/1996 | (CA) . |
| 42 13 553 | 5/1994 | (DE) . |
| 0 167 013 | 1/1986 | (EP) . |
| 0 222 728 | 5/1987 | (EP) . |
| 0 286 701 | 10/1988 | (EP) . |
| 0 217 784 | 1/1989 | (EP) . |
| 0 327 139 | 8/1989 | (EP) . |
| 0 785 052 | 7/1997 | (EP) . |
| WO 93/04826 | 3/1993 | (WO) . |

* cited by examiner

*Primary Examiner*—W. Donald Bray
(74) *Attorney, Agent, or Firm*—Young & Thompson

(57) ABSTRACT

To make the usable wood volume of the tree trunks as large as possible, octagonal or dodecagonal dressed timbers are proposed from which then boards or beams with inclined edges are cut. To produce octagonal or dodecagonal dressed timbers, in a first machining stage (11) two side surfaces (13) are milled off the tree trunk, it is then turned by 90° and two additional side surfaces (19) are milled off in a second machining station (17). Immediately thereafter in another machining station (21) with four (for octagonal dressed timbers) or eight (for dodecagonal dressed timbers) milling cutters (22) the remaining rough edges (20) are milled off.

20 Claims, 2 Drawing Sheets

10
11
12
13
14
15
16
17
18
19
20
21
22
23
24
28
a
b
b'
c
d 9
10
11
15
21
25
26
27
a
b
b'
c
d

PROCESS AND DEVICE FOR PRODUCTION OF OCTAGONAL OR POLYGONAL BEAMS

The invention relates to a process for machining of tree trunks to produce octagonal or polygonal dressed timbers in which on a tree trunk in a first machining step two vertical side surfaces are produced, whereupon the tree trunk is turned 90° and in a second machining step two more vertical side surfaces are produced, and a device which is especially suitable for executing the process.

Increasing the usable cross section of tree trunks by cutting them on four sides and with rough edges remaining between the four sides, resulting in a larger remaining wood mass, is known. If boards are to be cut from the tree trunks the rough edges are cut in stages in a subsequent step such that straight edges form in the subsequently cut boards.

The object of the invention is to devise a process and a device for machining of tree trunks in which the usable wood cross section of the tree trunks is improved or enlarged.

Compared to the above described form of machining, octagonal or dodecagonal cutting of a roughly round cross section yields a greater useful wood volume. When boards are cut from the tree trunk machined by the invention, they already have bevelled edges which are especially well suited for roofs and jointed timbering (weather boarding).

Other advantageous embodiments of the invention are follow from the following description of preferred embodiments of the invention with reference to the drawings.

Figure 9:
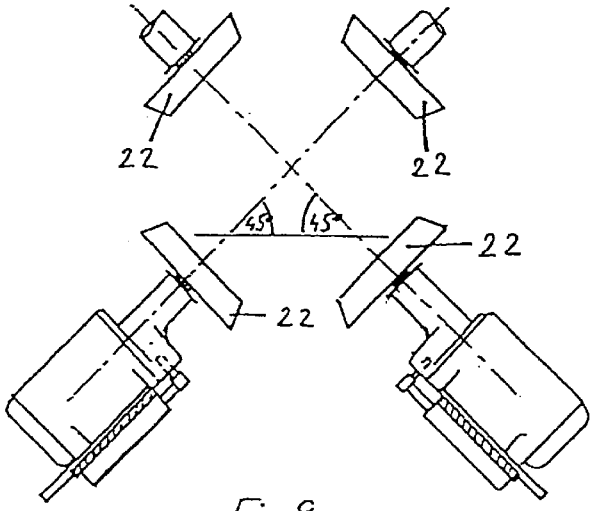

FIG. 9 schematically shows the machining tools which can be used in the device of the invention.

Figure 1:
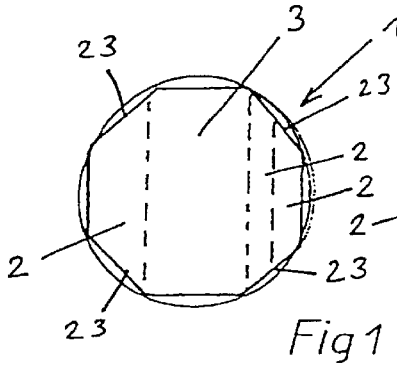
FIGS. 1 to 4 show the tree trunk cross sections which can be produced with the process as claimed in the invention and the device as claimed in the invention.
Figure 2:
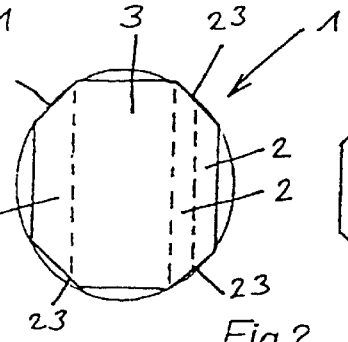
Figure 3:
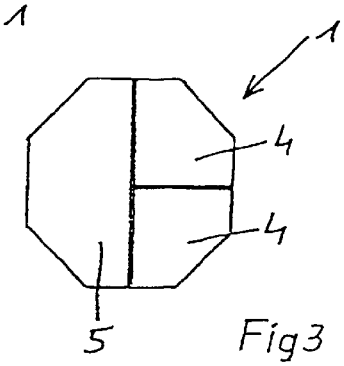

FIGS. 1 through 3 show beams 1 produced from tree trunks with octagonal cross sectional profile, from which as shown in FIGS. 1 and 2 boards with bevelled edges are cut so that in the middle a square 3 remains. As shown in FIG. 3 three beams 4 and 5 with different cross sectional shapes are cut from the octagonal cross sectional profile. Finally FIG. 4 shows a beam 6 with dodecagonal cross sectional profile from which likewise boards 7 are cut laterally so that a middle square 8 remains.

Figure 4:
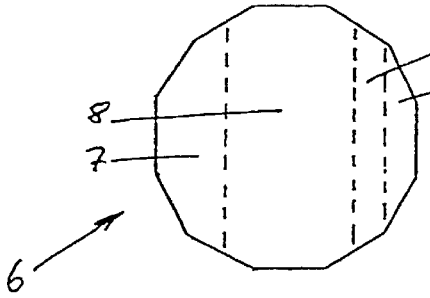
Figure 5:
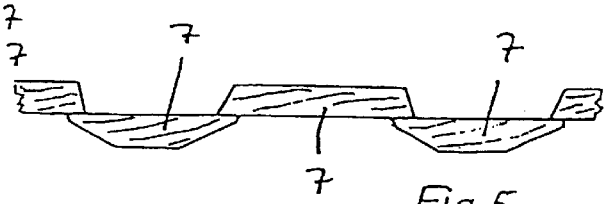
FIGS. 5 and 6 show embodiments of roof joint timbering with boards which have been cut from the tree trunk cross sections produced by in the invention.
Figure 6:
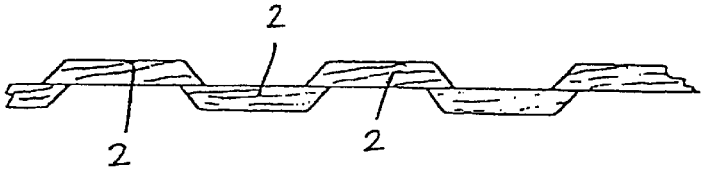

FIG. 5 shows roof joint timbering which consists of boards 7 produced as shown in FIGS. 4 and 6 shows roof joint timbering consisting of boards which were produced as shown in FIGS. 1 or 2.

Figure 7:
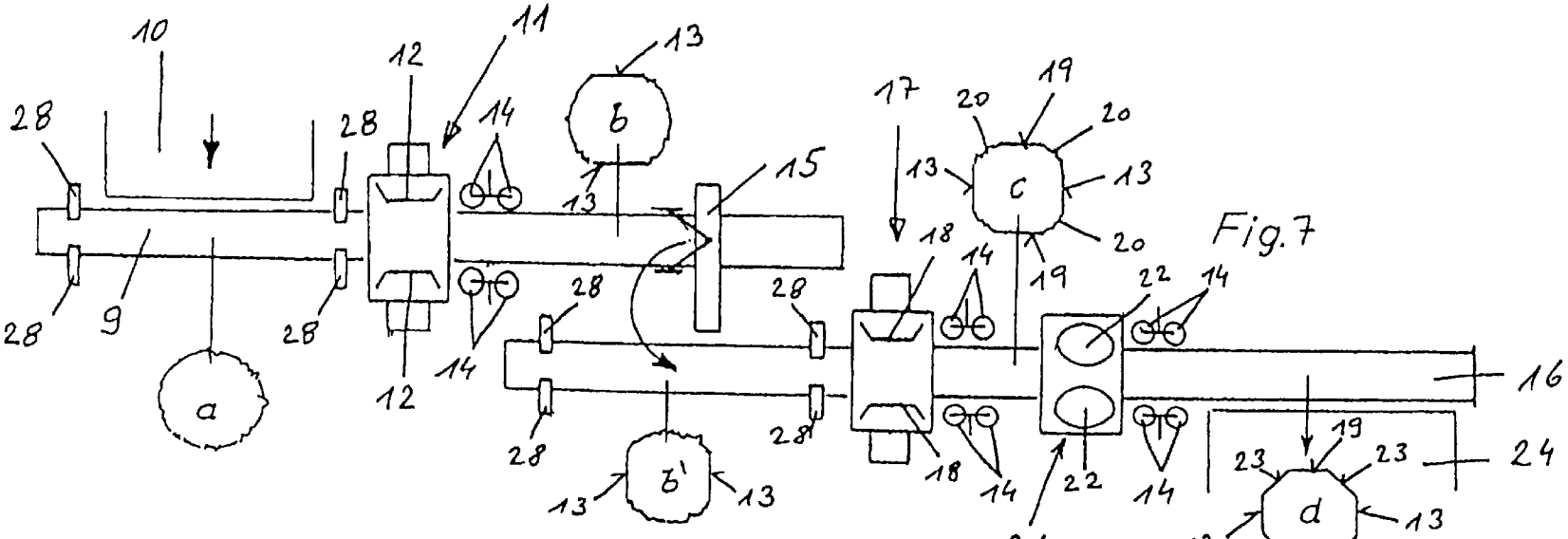
FIG. 7 shows a first embodiment of a device of the invention in which a tree trunk passes through the individual machining stations in one direction.

FIG. 7 shows a first embodiment of a device of the invention which has a conveyor means 9 consisting of its support table and a rotating toothed chain for feed of a tree trunk with a cross section a. The tree trunks are delivered by a cross feeder 10 and are placed on the conveyor means 9. The deposited tree trunk, after it has been aligned by means of guides 28 which can be moved symmetrically to the middle axis of the tree trunk, are pressed against a toothed chain from above by arms which can be hydraulically loaded and on the ends of which rollers or disks are pivotally supported and in this way they are held securely on the toothed chain. The tree trunk with a cross section a which is shown symbolically, after it has been deposited, passes through a first machining station 11 which has two milling cutters 12 which have a horizontally aligned axis of rotation and which produce two side surfaces 13 on the tree trunk, as is shown symbolically by the cross section b. Upon leaving the first machining station 11 the milled sides 13 of the tree trunk are grasped on either side by driven rollers 14 with vertically aligned axes of rotation, a so-called roller table which prevents the tree trunk from twisting or turning during machining.

After passing through the first machining station 11 the tree trunk is moved by a turning means 15 onto a second conveyor means 9 which runs parallel and partially next to the first conveyor means 9. In doing so the tree trunk is turned 90°, as is shown symbolically by the cross section b'. The second conveyor means 16 like the first conveyor means 9 has a rotating toothed chain, guides 28 and hold-downs, the tree trunk then lying on the toothed chain with one machined side 13. The tree trunk passes then through another machining station 17 with two milling cutters 18 with horizontally aligned axes of rotation which produce two additional side surfaces 19 on the tree trunk so that the tree trunk after leaving the machining station 17 has four surfaces 13, 19 with wide rough edges 20 which lie in between (see cross section c). After the machining station 17 the tree trunk is also grasped by a roller table with vertically aligned driven rollers 14.

Immediately after the machining station 17 or the roller table which follows it the tree trunk passes through a third machining station 21 with four milling tools 22 with axes of rotation which are inclined at an angle of 45° to the horizontal, as can be seen in FIG. 9. With the milling cutters 22 the rough edges 20 are removed, and the width of the surfaces 23 produced in this way can be influenced by the advance of the milling cutters 22, i.e. their distance from one another, as is shown in FIGS. 1 and 2.

After leaving the third machining station 21 which is followed on the outlet side by another roller table with driven rollers 14 the tree trunk machined on eight sides (cross section d) is removed laterally via a chain conveyor 24.

Figure 8:
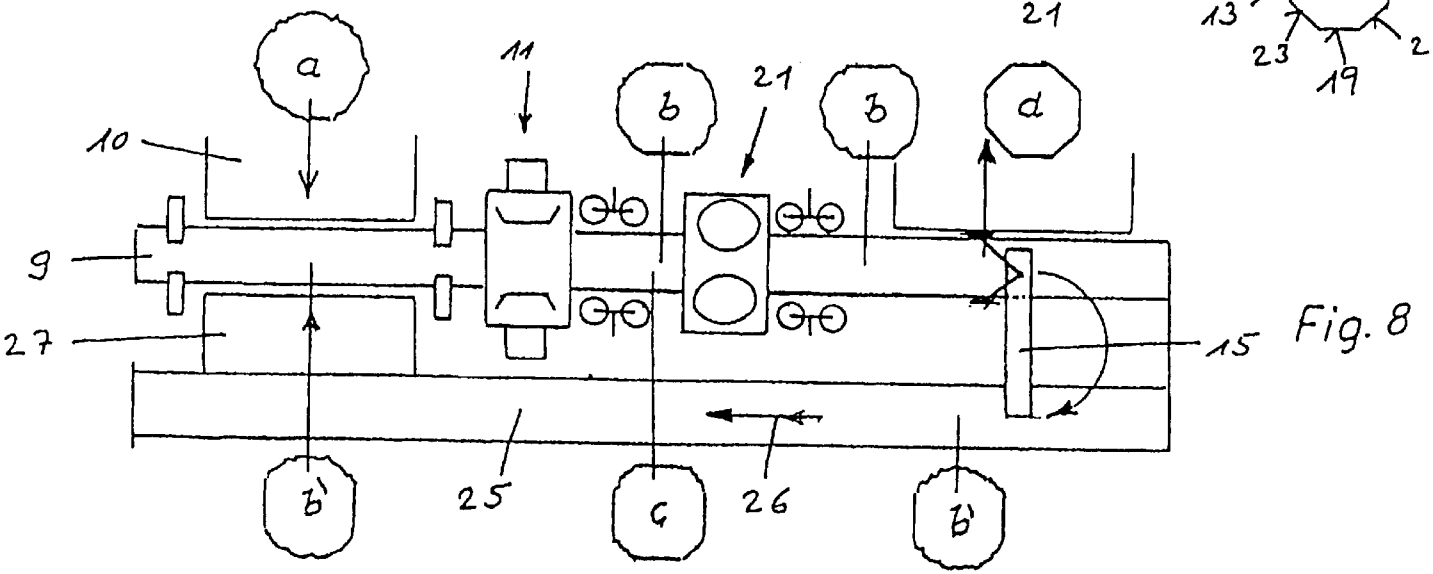
FIG. 8 shows another embodiment of a device of in the invention with a return conveyor means in which the tree trunk passes through a machining station twice.

In FIG. 8 a simplified embodiment of the device as claimed in the invention which requires less space is shown. The embodiment as shown in FIG. 8 differs from the one shown in FIG. 7 in that the second machining station 17 is eliminated and next to the conveyor means 9 there is a return conveyor means 25.

A tree trunk with a cross section a is again placed via a cross feeder 10 on the toothed chain of the conveyor means 9 and is held down by rollers or disks on the toothed chain. The tree trunk then passes through the first machining station 11 after which it in turn has a cross section b. The tools with the horizontally inclined axes of rotation of the machining station 21 are set back so that they are not working in the first pass of the tree trunk. The tree trunk with the cross section b is then moved by the turning device 15 from the conveyor means 9 onto the return conveyor means **2*b* and in doing so is turned by 90° (cross section b'). The tree trunk is then conveyed back in the direction of the arrow 26 and is placed again on the conveyor means 9 by a cross conveyor 27. The tree trunk then passes a second time through the machining station 11, the tree trunk acquiring a cross section c, and then through the machining station 21 with the milling tools 22 now advanced, by which the tree trunk acquires an octagonal cross section d. After passing through the machining station 21 the finish-machined tree trunk is again removed laterally via a chain conveyor 24**.

Basically, configuring the conveyor means 9 to allow it to be driven in two conveyance directions is also conceivable, by which the return conveyor means 25 would be superfluous. The tree trunk would then have to be turned by 90° only after the first passage through the machining station 11.

If instead of an octagonal product a dodecagonal product is to be produced, the machining station 21 is refitted accordingly so that it has a total of eight milling tools 22 with axes of rotation which are aligned at an angle of 30° and 60° to the horizontal or to the axes of rotation of the adjacent milling tools.

As required the dressed timbers are cut into boards and squares (FIGS. 1, 2 and 4) or beams (FIG. 3) in a downstream saw.

To adapt to the different diameters of the tree trunks and to determine the width of the surfaces to be produced, the milling tools 12, 18, 22 can be advanced proportionally to the middle axis of the tree trunk. To do this, hydraulic adjusting cylinders of the milling tools 12, 18, 22 which are not shown in the drawings are equipped with graduated rulers and assigned outside magnets and proportional valves and are accordingly triggered by a conventional control means which likewise is not shown. After ascertaining the diameter of the top end of the tree trunk a sectional drawing is prepared which is accepted by the control means which then undertakes the corresponding settings of the milling tools 12, 18, 22. The height of the axes of the machining tools over the toothed chain is controlled such that the middle axis of the tree trunk intersects the axes of rotation of the machining tools.

The described embodiments of the device as claimed in the invention are very efficient since tree trunks prearranged by the thickness of the top end can be machined in succession.

In summary, one embodiment of the process as claimed in the invention can be described as follows.

To make the usable wood volume of the tree trunks as large as possible, as claimed in the invention octagonal or dodecagonal dressed timbers are proposed from which then boards or beams with inclined edges are cut.

To produce octagonal or dodecagonal dressed timbers, in a first machining stage 11 two side surfaces 13 are milled off the tree trunk, it is then turned by 90° and two additional side surfaces 19 are milled off in a second machining station 17.

Immediately thereafter in another machining station 21 with four (for octagonal dressed timbers) or eight (for dodecagonal dressed timbers) milling cutters 22 the remaining rough edges 20 are milled off.

What is claimed is:

1. Process for machining of tree trunks to produce octagonal or polygonal dressed timbers, in which on a tree trunk in a first machining step two vertical side surfaces are produced, whereupon the tree trunk is turned 90° and in a second machining step two more vertical side surfaces are produced, characterized in that then in a third machining step other surfaces are produced between the existing four side surfaces on the tree trunk which are inclined at an angle between 15° and 75° to the existing four side surfaces.

2. Process as claimed in claim 1, wherein the second and third machining step are executed in a single stage.

3. Process as claimed in claim 1, wherein in the third machining step four additional surfaces are produced at the same time at an angle of 45° to the first four side surfaces.

4. Process as claimed in claim 1, wherein in the third machining step eight additional surfaces are produced at the same time at an angle of 30° or 60° to the first four side surfaces.

5. Process as claimed in claim 1, wherein after execution of the first machining step in a first machining station the tree trunk is conveyed back and after it has been turned by 90°, passes through the first machining station again for executing the second machining step.

6. Device, especially for executing the process as claimed in claim 1, with a conveyor means, with a first cutting means with milling or sawing tools with horizontal axis of rotation, with a subsequent turning device to turn the tree trunk by 90°, and with a second cutting means with milling or sawing tools with horizontal axis of rotation, characterized by another cutting means (21) with at least four sawing or milling tools (22) with axes of rotation, which is inclined at an angle between 15 and 75° to the horizontal.

7. Device as claimed in claim 6, wherein a first conveyor means (9) is assigned to the first cutting means (11) and another conveyor means (16) for the tree trunk is assigned to the second and third cutting means (17, 21).

8. Device as claimed in claim 7, wherein the turning device (15) moves the tree trunk from the first conveyor means (9) to the second conveyor means (16).

9. Device as claimed in claim 6, wherein the tools (22) of the other cutting means (21) are located directly following the tools (18) of the second cutting means (17).

10. Device, especially for executing the process as claimed in claim 1, with a conveyor means, with a first cutting means with milling or sawing tools with horizontal axis of rotation, and with a turning means to turn the tree trunk by 90°, characterized by another cutting means (17) with at least four sawing or milling tools (22) with axes of rotation, which is inclined at an angle between 15 and 75° to the horizontal.

11. Device as claimed in claim 10, wherein the tools (22) of the other cutting means (21) are located directly following the tools (12) of the first cutting means (11).

12. Device as claimed in claim 10, wherein the conveyor means (9) can be driven in the opposite conveyor direction.

13. Device as claimed in claim 10, wherein next to the conveyor means (9) for the tree trunk there is a return conveyor means (25).

14. Device as claimed in claim 10, wherein the turning device (15) is located following the other cutting means (17).

15. Device as claimed in claim 13, wherein the turning device (15) moves the tree trunk from the first conveyor means (9) to the return conveyor means (25).

16. Device as claimed in claim 6, wherein the other cutting means (17) has four tools (22) with axes inclined at an angle of 45° to the horizontal.

17. Device as claimed in claim 6, wherein the other cutting means (17) has eight tools (22) with axes inclined at an angle of 30° or 60° to the horizontal.

18. Device as claimed in claim 6, wherein following the cutting means (11, 17, 21) there are removal devices (14) for the tree trunk.

19. Process as claimed in claim 1, wherein said other surfaces produced in said third machining step have widths less than said vertical side surfaces produced in said first and second machining steps.

20. Device as claimed in claim 10, wherein said another cutting means (17) produces surfaces on said tree trunk which have lesser widths than the surfaces produced on said tree trunk by said first cutting means.

* * * * *